US006378628B1

(12) United States Patent
McGuire et al.

(10) Patent No.: US 6,378,628 B1
(45) **Date of Patent: *Apr. 30, 2002**

(54) MONITORING SYSTEM FOR DRILLING OPERATIONS

(76) Inventors: Louis L. McGuire, 2212 Ventura, Odessa, TX (US) 79763; Weldon McGuire, 11513 W. County Rd. 56, Midland, TX (US) 79707; Frank Brych, 1501 Alameda, Odessa, TX (US) 79763

( * ) Notice: Subject to any disclaimer, the term of this patent is extended or adjusted under 35 U.S.C. 154(b) by 0 days.

This patent is subject to a terminal disclaimer.

(21) Appl. No.: 09/596,476

(22) Filed: Jun. 16, 2000

Related U.S. Application Data

(63) Continuation-in-part of application No. 09/085,036, filed on May 26, 1998, now Pat. No. 6,105,689.

(51) Int. Cl.[7] ..... C09K 7/00
(52) U.S. Cl. ..... 175/48; 175/38
(58) Field of Search ..... 175/24, 38, 48, 175/206, 207; 73/152.03, 152.04, 152.18, 152.19, 152.21, 152.22

(56) References Cited

U.S. PATENT DOCUMENTS

| | | | | |
|---|---|---|---|---|
| 2,341,169 A | | 2/1944 | Wilson et al. | |
| 3,213,939 A | | 10/1965 | Records | |
| 3,219,107 A | | 11/1965 | Brown, Jr. et al. | |
| 3,365,009 A | | 1/1968 | Burnham et al. | |
| 3,498,393 A | | 3/1970 | West et al. | |
| 3,667,555 A | * | 6/1972 | Elenburg | 175/60 |
| 3,726,136 A | * | 4/1973 | McKean et al. | 175/48 |
| 3,815,673 A | * | 6/1974 | Bruce et al. | 175/25 X |
| 3,955,411 A | * | 5/1976 | Lawson, Jr. | 175/48 X |
| 4,315,553 A | * | 2/1982 | Stallings | 175/207 |
| 4,511,374 A | | 4/1985 | Heath | |
| 4,577,700 A | * | 3/1986 | Dellinger et al. | 175/40 |
| 4,635,735 A | * | 1/1987 | Crownover | 175/48 |
| 4,689,775 A | * | 8/1987 | Scherbatskoy | 175/48 X |
| 4,715,022 A | * | 12/1987 | Yeo | 175/48 X |
| 4,733,233 A | * | 3/1988 | Grosso et al. | 175/48 X |
| 5,010,966 A | | 4/1991 | Stokley | |
| 5,154,078 A | * | 10/1992 | Codazzi | 175/48 X |
| 5,249,635 A | * | 10/1993 | King et al. | 175/48 |
| 5,857,522 A | * | 1/1999 | Bradfield et al. | 166/267 |
| 5,890,549 A | * | 4/1999 | Sprehe | 175/206 X |
| 6,105,689 A | * | 8/2000 | McGuire et al. | 175/48 |

FOREIGN PATENT DOCUMENTS

EP 466229 * 1/1992

* cited by examiner

*Primary Examiner*—H. Shackelford
*Assistant Examiner*—Jong-Suk Lee
(74) *Attorney, Agent, or Firm*—Milburn & Peterson, P.C.; Robert C. Peterson

(57) ABSTRACT

A mud separator monitoring system utilizing electronic transducers positioned in various locations in the mud separator and the lines leading from the mud separator to the mud return pit and gas discharge flare for obtaining data during drilling operations to calculate the volume of gas retained in the drilling fluid, the hydrostatic head of the drilling fluid and gas pressure in the separator on a continuing basis and informing field personnel of conditions in the mud separator indicating potential hazard. The system further monitors continuously the volume of injected gases and hydrocarbon gases circulated during drilling operations for making adjustments to the volume of injected gases required to sustain the drilling operations.

10 Claims, 3 Drawing Sheets

MONITORING SYSTEM FOR DRILLING OPERATIONS

This is a: continuation-in-part, of application Ser. No. 09/085,036 filed May 26, 1998 now U.S. Pat. No. 6,105,689.

BACKGROUND OF THE INVENTION

This invention relates to the art of monitoring the hydrostatic pressure of drilling fluid in the mud separator to adequately suppress the differential changes of the formation pressure encountered during oil and gas well drilling operations. More particularly, it relates to monitoring parameters associated with the mud separator correlatable to the minimal hydrostatic pressures of the drilling fluid against the formation pressure necessary to avoid blowout hazards.

The invention further relates to monitoring parameters in air drilling operations to determine the volume of injected gases and formation gases being circulated and avoid hazards of formation gases entering the aqueous liquid pit.

Accepted drilling operations utilize drilling fluid or "mud" to provide hydrostatic pressure against the formation pressure to prevent the formation pressure from exceeding the hydrostatic pressure of the mud and consequently causing a blow out of the well. In the drilling procedure for oil and gas wells it is common to circulate mud through the hollow drill stem, beyond the drill bit and return it between the drill stem and bore hole or casing. Upon return of the mud to the surface it is transferred to a mud settling pit to settle out the solid cuttings and the mud is recycled. Generally, the mud is processed through a mud separator before going to the mud settling pit. The function of the mud separator is to separate entrained gas from the mud and the solid cuttings and prevent gaseous hydrocarbons from entering the mud pit which could create a disastrous hazard if hydrocarbons got into the mud pit and were ignited. It should be noted that quantities of oil entrained in the mud are not separated at the mud separator. In most cases removal of oil from the mud is a separate operation.

In air drilling operations the mud separator is used to separate aqueous liquids, which are used in air drilling operations to provide lubrication of the drill bit, from injected gases and formation gases and further permits disposal of the formation solid cuttings.

Not only is well blowout a hazard in oil and gas drilling operations, but also blow over into the mud pit from the mud separator if the gas pressure in the separator exceeds the hydrostatic pressure of the mud leg in the mud separator. This could occur if preventative or corrective action is not taken timely.

Some present drilling operations are conducted where the hydrostatic pressure of the mud is less than the formation pressure, which is frequently referred to as under balanced drilling. Such operations increase the bit penetration rate, with a generally longer bit life thus decreasing the cost of drilling the well and decreases the risk of fracturing a low pressure formation by forcing drilling mud into the formation. Thus, it is certainly desirable in drilling operations to conduct under balanced drilling.

Often in drilling oil and gas wells extremely high pressure gas pockets will be encountered with the potential of the well blowing out. However, frequently the high pressure pockets are of such a low porosity that even though high pressure exists in the pores of the strata not enough of a volume of the high pressure gas gets into the well bore to cause an immediate concern. Such encounters of high pressure pockets are reflected in the mud returned to the surface as entrained gas which lessens the density of the drilling fluid and consequently the drilling fluid exerts less hydrostatic pressure. Further, when liquid hydrocarbons are encountered the hydrocarbons further reduce the density of the drilling fluid. When such drilling fluids reach the mud separator the density of the drilling mud may very significantly from the initial density thus the density of the drilling mud in the mud separator may have a density of 95% of the original density.

U.S. Pat. No. 3,365,009 issued to Burnham discloses a method having flow parameter regulating means for controlling the flow rate and pressure of drilling fluid emanating from a well and gas separating means for liberating gas entrained in the fluid prior to recirculating. The regulating apparatus includes a bladder valve with an actuating chamber which receives compressed gas for flexing the resilient bladder to achieve the desired size of the control passageway through the bladder, thus the pressure ratio across the bladder valve may be varied by varying the control passageway.

U.S. Pat. No. 5,010,966 issued to Stokley teaches a method of receiving a return of drilling fluid from a well being drilled, in which the hydrostatic pressure of the drilling fluid is less than the formation pressure, and controlling the flow and pressure of the return, separating oil and gas from the drilling fluid at the surface, and then returning the drilling fluid to the well and separating the oil and gas phases for further disposition.

U.S. Pat. No. 2,314,169 to Wilson discloses a method for detecting gas in well drilling fluids and in particular a method and apparatus for separating and detecting the minute amounts of gas in the drilling fluid during drilling for determining the location of the strata source of the gas.

U.S. Pat. No. 3,213,939 issued to Records discloses a method and apparatus which involves maintaining a desired back pressure on the drilling fluid or mud by means of a controlled gas pressure, which pressure together with the column of drilling fluid assure that a well blow out is prevented.

U.S. Pat. No. 3,498,393 issued to West discloses a method of blow out protection wherein the mud returned to the surface is introduced into a separator and gases retained in the mud are separated from the mud. The gas is then passed through appropriate size lines wherein instruments are located which measure the volume of gas flow by such measurements the operator is appraised of increases and decreases of gas flow rates in sufficient time to take appropriate action as required. The system is designed for drilling operations in which the least possible hydrostatic head is maintained by the drilling fluid.

Assuming constant permeability of the gas strata, from which the gas in the return mud emanates, the flow rate of the gas from the mud separator is comparable to the pressure in the bottom of the well. Comparing the flow rate measurements of the gas from the separator with measurements taken earlier, the rate of change in the flow rate of the gas from the mud separator may be determined. These measurements thus allow the driller to predict what is happening down hole at any given time and then adjust the hydrostatic head by increasing or decreasing density of the mud.

SUMMARY OF THE INVENTION

The present invention provides an integrated system that uses the latest electronic and computer technology to provide reliable, instantaneous conditions of drilling fluid and entrained hydrocarbons in the mud separator whereby the drilling operation can be adjusted accordingly. Of particular importance, the invention utilizes the measurements of the hydrostatic pressure of the mud in the mud separator thus detecting changes in the density of the mud returned from the well bore and a significant change of the hydrostatic pressure in the well bore. The gas pressure transducer in the mud separator reading is compared with the hydrostatic pressure of the mud leg in the mud separator to assess the possible blow dry of the mud separator with gas reaching the mud pit. Likewise, the flow rate of the mud from the well bore can be decreased to prevent blow over of the gas into the mud pit and possibly causing a hazard.

In another aspect of the invention, the drilling operation is conducted using air with or without additional nitrogen for drilling operations, in which case, the drilling operation is monitored with pressure and temperature transducers in close proximity to each other in the flare line near the drill site and second pressure transducer in the flare line near the discharge disposal unit which may be a flare or other control burning. Using this latest air drilling technique avoids the necessity of using drilling fluid or mud and consequently the mud pit is maintained to shut-in the well for installation of casing and under emergency situations requiring immediate shut down of the drilling operation and "killing" the well to prevent blowout in case the downhole pressure exceeds the air drilling pressure.

More particularly the present invention provides a monitoring system using electronic transducers to obtain data to calculate the volume of gas and determine the gas pressure and the hydrostatic pressure of the mud leg in the mud separator on a continuing basis thus informing the field personnel of conditions that may or may not require immediate response. The system utilizes transducers at certain locations to obtain gas pressures and hydrostatic pressures of the drilling fluid which a computer analyzes.

In addition, the present invention provides a monitoring system utilizing electronic transducers to obtain data to calculate the volume of formation gas and determine the gas pressure at the well bore on a continuous basis thus informing the field personnel of conditions that may or may not require immediate response. All of which can be done without the use of drilling mud and monitoring of a mud separator.

An object of the invention is to provide continuous data to a computer for calculating gas volumes utilizing the F. H. Oliphant formula (*Practical Petroleum Engineers' Handbook,* Third Edition, page 632) or other recognized formulae, and determining the hydrostatic mud leg by the formula p=0.052 dh where "p" is the hydrostatic head in p.s.i., "d" is the density of the drilling mud in lbs. per gallon and "h" is the height of mud leg in feet. Preferably, a pressure transducer may be placed at the bottom of the discharge of the mud separator to directly obtain the hydrostatic pressure of the mud in the mud separator. Further, gas retention percentiles are derived from a transducer in the mud section of the mud separator. The transducer reading of the mud leg hydrostatic pressure is subtracted from the calculated mud leg hydrostatic pressure of the mud density in use. The difference is divided by the calculated mud leg hydrostatic pressure and multiplied by 100 to obtain the gas retention percentage. Using the gas retention data and incorporating the Drillpro® method of gas expansion calculation, a more accurate bottom hole pressure can be obtained.

An additional object of the invention is to collect and analyze adequate data to obtain for injected gases or air drilling with treated water the calculated initial and corrected volume of injected gases, the calculated volume of injected gases, and the total volume of injected and formation gases, then adjusting the volume of injected gases and formation gases for the corrected volumes by correcting for the formation gases specific gravity and the injected gases specific gravities that more accurately ascertain the formation gases volume and injected gases volume that constitute the total volume of formation and injected gases whereby the design engineered volume of gases is maintained with the total volume of formation and injected gases necessary to regulate the pressure of the gases during drilling with the minimum of injected gases.

A further object of the invention is to collect and analyze adequate data to obtain the volume of formation gas from an oil or gas well being drilled by injected gases or air techniques with air and nitrogen or other gases and treated water using the Weymouth modified formula (*Practical Petroleum Engineers' Handbook,* third edition, page 912) in a series of unique calculations to determine the entire volume of injected gas and formation gas circulation and allocate the total volume between injected gas and formation gas.

Another object of the invention is to use the latest electronic and computer technology for monitoring data from transducers to give instantaneous readings of changes in the mud separator gas and hydrostatic mud leg pressures thereby enabling control of the drilling operation by appropriately adjusting chokes and pump rates.

DESCRIPTION OF PREFERRED EMBODIMENT

Figure 1:
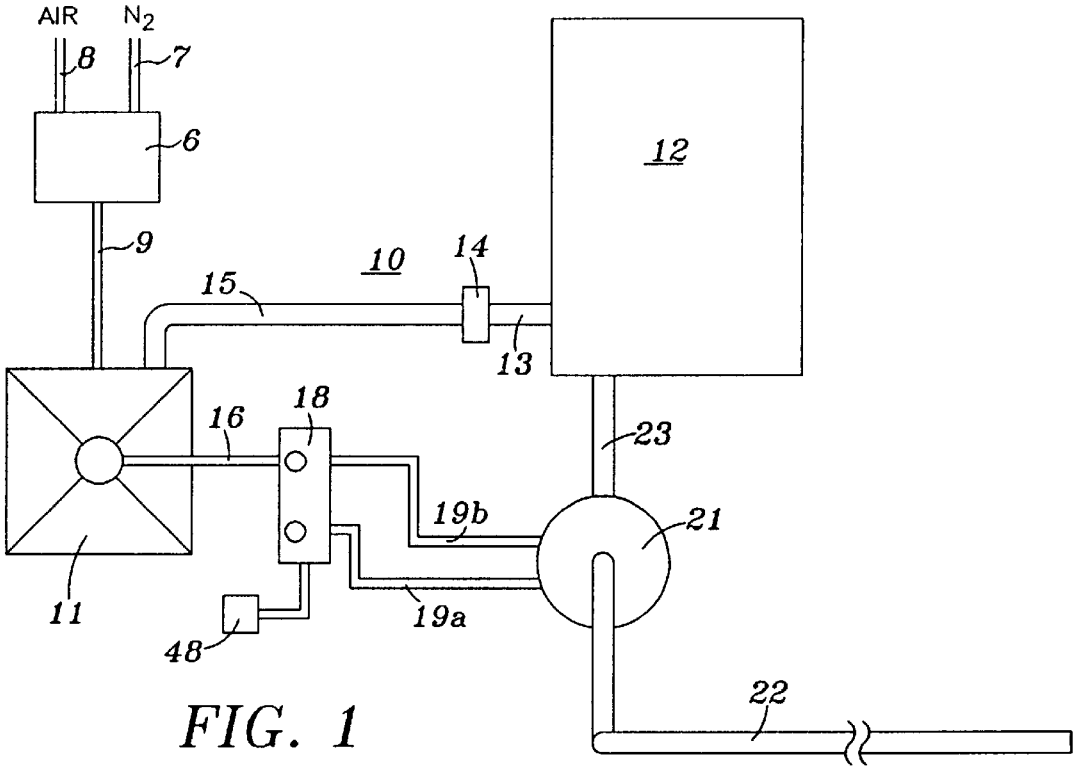
FIG. 1 is a plan view schematically illustrating the well being drilled, the mud separator, choke manifold (,) compressor and the mud pit.

Referring now to FIG. 1, a typical layout 10 of the drill site equipment is illustrated. The drill site 11 includes a compressor 6 with a nitrogen inlet line 7, air inlet line 8 and a compressed fluid or injection line 9 providing compressed gases to the drill site 11. The drill site 11 is provided drilling fluid or mud 28 from mud pit 12 through lines 13 into pump 14 and from pump 14 through line 15 to the drill site 11. Drilling mud 28 is circulated down the drill stem and returned through line 16 into choke manifold 18 and then through line 19*a* or 19*b* into separator 21 through line 19. Line 22 from separator 21 carries the separated gaseous hydrocarbons 24 to a flare (not shown) or other equipment for recovery and/or disposal. Mud 28 from the formation transferred into mud separator 21 is returned to the mud pit 12 through line 23 for any treatment and re-use.

Figure 2:
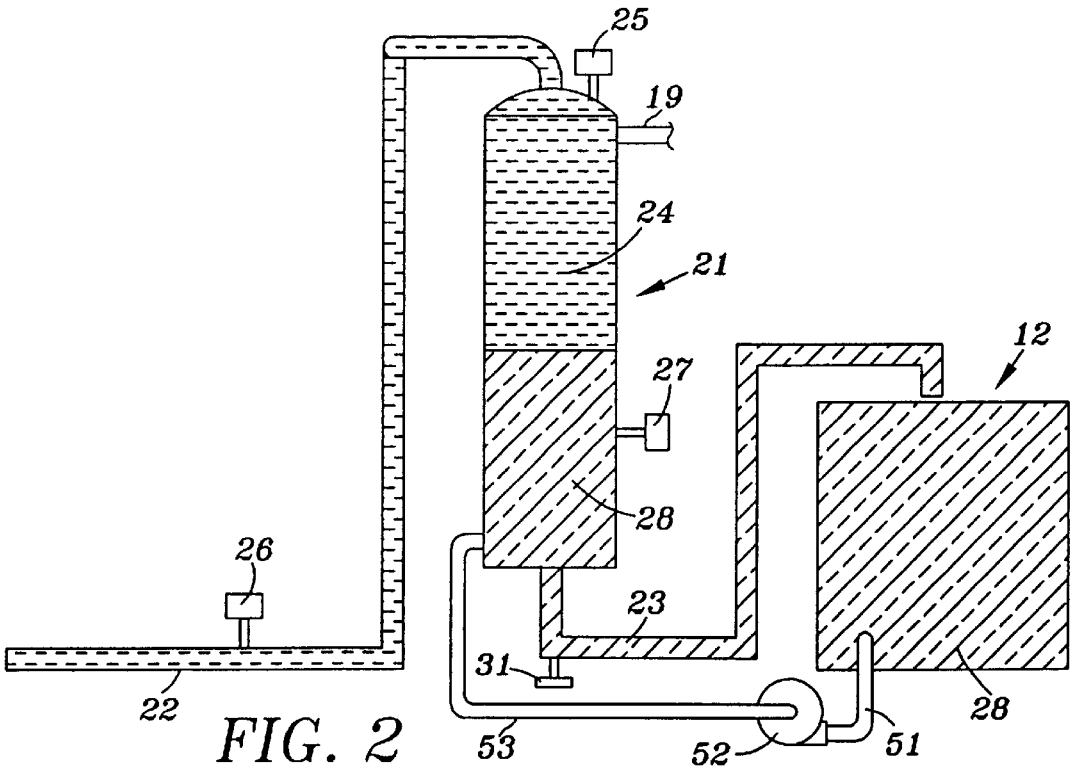
FIG. 2 is a schematic side elevation view of the mud separator and the mud pit.

Referring now to FIG. 2, mud separator 21 is equipped with a first gas pressure transducer 25 and a second gas pressure transducer 26 is placed in line 22. The second gas pressure transducer 26 is positioned in line 22 in a straight section at least 30' long and preferably 100' in either direction which provides substantially laminar flow of the gas 24 in line 22 for accuracy in detecting the pressure. A thermal transducer 27 monitors the temperature of mud 28 in mud separator 21 for making temperature correction in the gas volume calculation. A mud pressure transducer 31 is provided at the bottom of mud separator 21 for determining in conjunction with gas pressure transducer 25, the hydrostatic pressure of the mud 28. The mud 28 is returned to the mud pit 12 through line 23.

Figure 3:
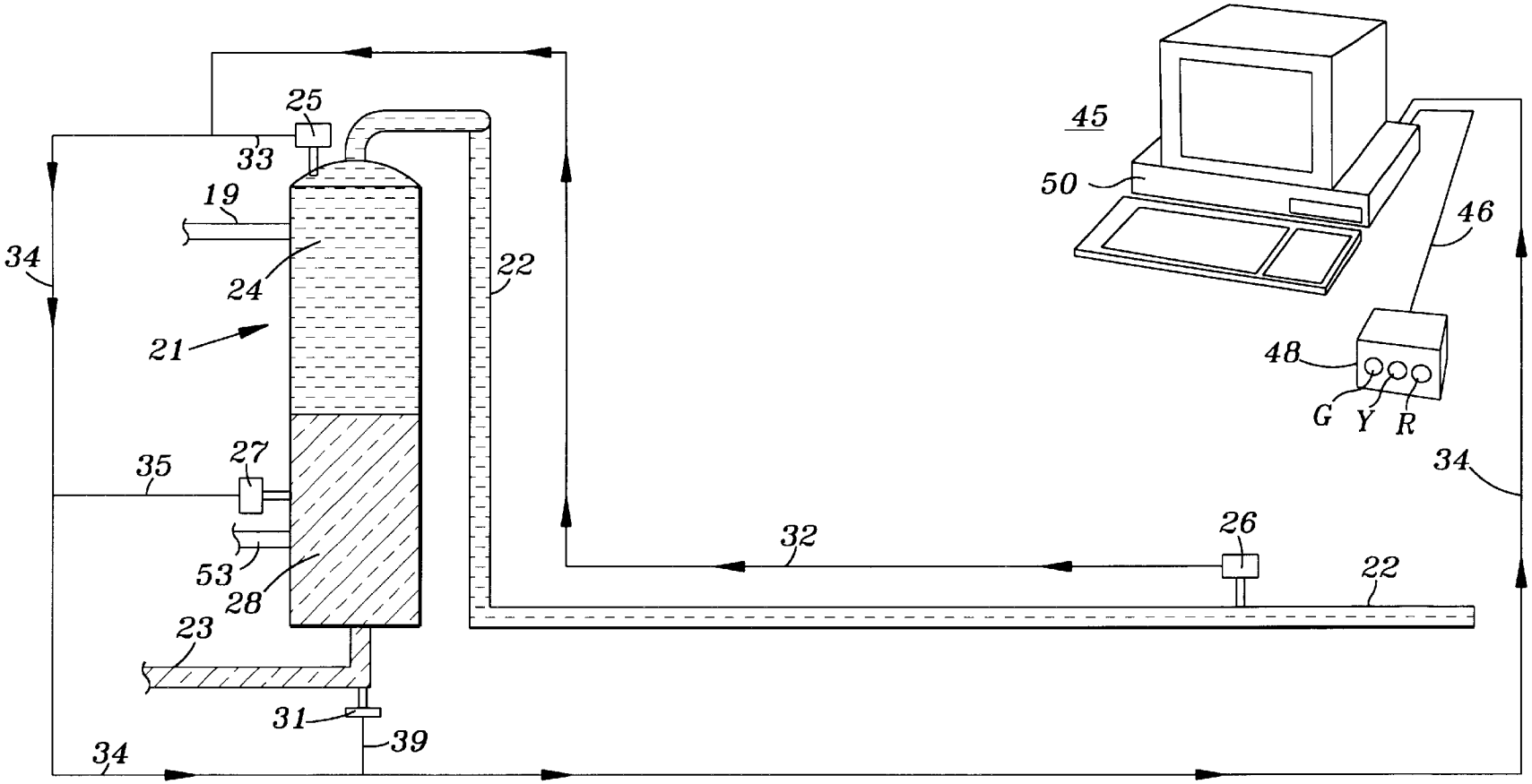
FIG. 3 is a schematic view of the mud separator and perspective view of the control center monitoring unit and drilling floor status box.

Referring now to FIG. 3, the first gas pressure transducer 25 monitors the gas pressure in the top of mud separator 21. The second gas pressure transducer 26 monitors the gas pressure in line 22 in a straight portion of line 22 that extends at least 30' on either side of second gas pressure transducer 26. The distance is maintained in order to assure substantially laminar flow pass the gas pressure transducer 26. Thermal transducer 27 is connected to mud separator 21 to determine the temperature of mud 28 in mud separator 21. The signal from gas pressure transducer 26 is carried by electrical cable 32 and the signal from gas pressure transducer 25 is carried by electrical cable 33 and joins with electrical cable 32 to form cable bundle 34. Thermal transducer 27 signal is carried by electrical cable 35 and joins electrical cable bundle 34 at the junction between electrical cable bundle 34 and electrical cable 35. The mud leg transducer 31 which monitors the hydrostatic pressure of mud 28 in return line 23 to the mud pit 12 is connected by electrical cable 39 and joins electrical cable bundle 34. Electrical cable bundle 34 is coupled to control center monitoring unit 45. Monitor 45 is connected by electrical cable 46 to a drilling floor status box 48. The monitor display 48 has a green light "G" which is lit when the gas pressure transducer 25 pressure reading is at a safe or non-cautionary percentage of the mud leg hydrostatic pressure. The monitor display 48 has a yellow light "Y" which is lit when the gas pressure transducer 25 pressure reading is between a cautionary and an unsafe percentage of the mud leg hydrostatic pressure. The monitor display 48 has a red light "R" which is lit when the gas pressure transducer 25 pressure reading reaches an unsafe percentage of the mud leg hydrostatic pressure. When the red light "R" is lit simultaneously an audible alarm is sounded to alert the drilling crew to make adjustments to the hydrostatic pressure by adjusting the hydraulic mud chokes 18 to decrease the flow of mud 28 into the mud separator 21. Typically, a change in the density of the mud 28 in the mud separator 21 of 10% would cause a 10% decrease in the mud leg hydrostatic pressure and if the gas pressure transducer pressure reading initially equaled 90% of the mud leg hydrostatic pressure, then the red light "R" and the audible alarm would be energized. The control center 45 processes the data from all the transducers. These data are processed by the computer 50 and calculated, displayed and recorded for a permanent record of that specific well.

The volume of gas is calculated using the F. H. Oliphant formula as follows:

$$\text{Equation A:}\quad Q = 42_a\sqrt{\frac{P_1^2 - P_2^2}{L}}$$

where:

Q=discharge in cubic feet per hour

42=a constant $P_1$=initial pressure in lbs. Per square inch, absolute $P_2$=final pressure in pounds per square inches, absolute L=length of line in miles a=diameter coefficient The formula assumes specific gravity of gas at 0.6. Consequently, for other specific gravities, multiply the volume in cubic feet per hour in Equation A by Equation B to obtain a corrected Q volume in cubic feet per hour:

$$\text{Equation B:}\quad Q_C = Q\sqrt{\frac{.06}{sp\cdot \text{gr}\cdot \text{gas}}}$$

Q=discharge im CFH $Q_C$=corrected volume

The gas calculation process using the F. W. Oliphant formula above with the following parameter corrected for the transducer pressure units, are as follows: The mud separator 21 gas pressure measured in ounces by pressure transducer 25, vent line 22 pressure measured in inches of water by pressure transducer 26 and the calculated length of pipe, for example, a 90-degree ell is equal to 59 feet (see Table 6–35—Loss in Air or Gas Pressure Produced by Fitttings, *Practical Petroleum Engineers' Handbook,* page 692).

In the injected gases or air drilling techniques, the mud separator is used to separate the injected gases and formation gases and transfer them to a flare or other safe disposal apparatus. The treated water or aqueous liquid used for cooling the drill is maintained at a level in the gas separator such that the treated water leg hydrostatic pressure exceeds the gas pressure in the separator. Also, the treated water contains the solid cuttings from the formation that are transferred from the separator to the treated water pit. In order to maintain adequate treated water pump 52 is provided with its suction end connected by pipe 51 to pit 12 which contains treated water and solid cuttings from the formation. The pump 52 pumps the treated water through pipe 53 into the separator. Although FIGS. 1 through 3 are illustrated using drilling mud as opposed to a drilling fluid, such as treated water, the operations are similar.

Figure 4:
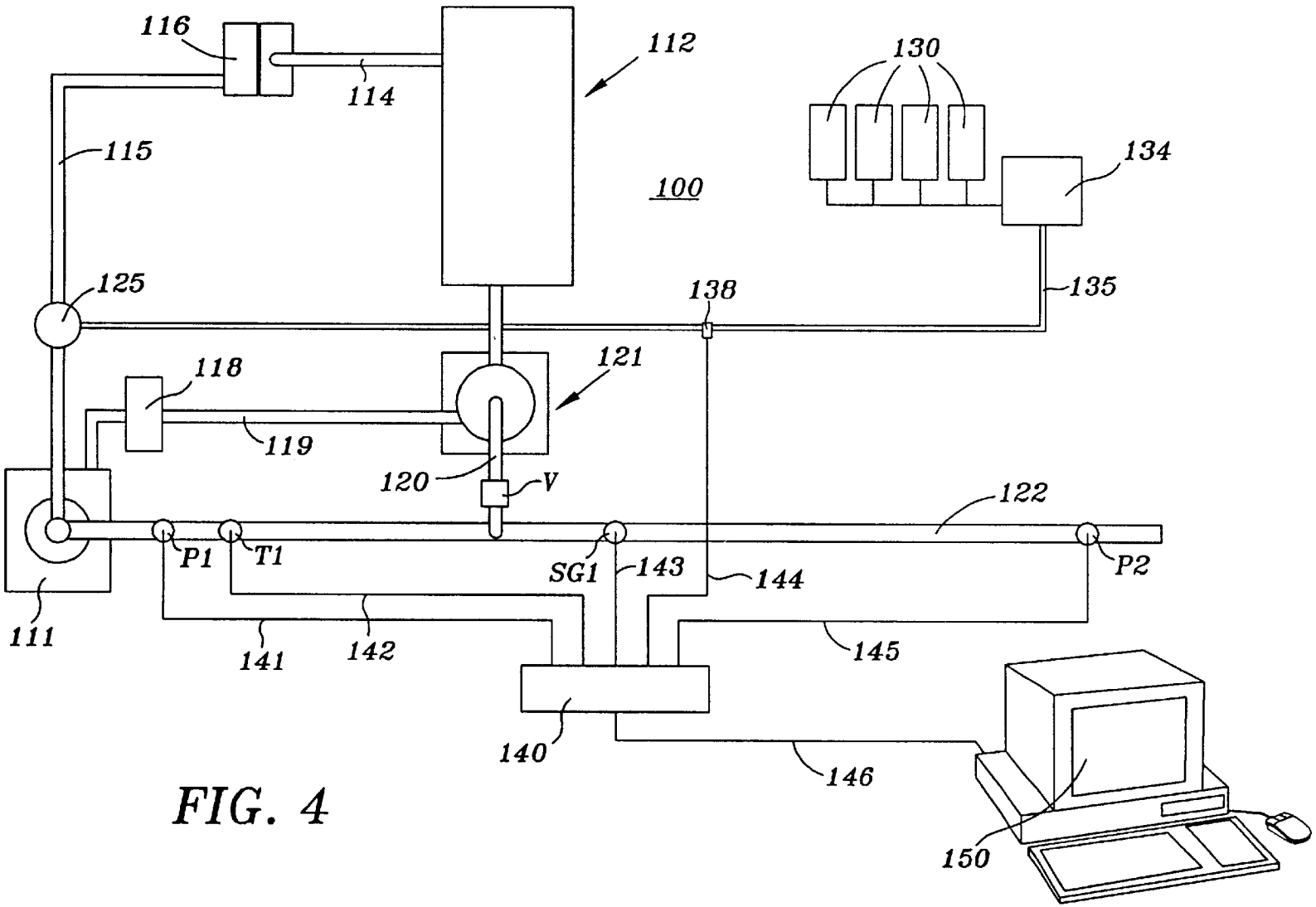
FIG. 4, a schematic view of the apparatus and perspective view of the control center monitoring unit and drilling floor status box, illustrating the air drilling operation.

Referring now to FIG. 4, a typical layout of the drill site equipment for air drilling and monitoring the drilling operation is illustrated. The drill site 111 is provided air from air pumps 130 which may or may not have additional nitrogen added in nitrogen booster 134 through air line 135 to a manifold 125 and then to the drill site 111. Mud pit 112 is connected to mud pump 116 by mud line 114 and mud pumps 116 is connected to manifold 125 by mud line 115. Mud separator 121 is connected to the choke manifold 118 by flow line 119 and the mud separator 121 is further connected to flare line 122 by line 120 having intermediate valve V therein to permit flaring of gas from mud separator 121. Junction box 140 is connected by cable bundle 146. The signal from pressure transducer P1 is carried by electrical cable 141 to junction box 140. The signal from temperature transducer T1 is carried by electrical cable 142 to junction box 140. The signal from specific gravity transducer SG1 is carried by electrical cable 143 to junction box 140. The electrical signal from air discharge flow meter 138 is carried by electrical cable 144 to junction box 140. The signal from pressure transducer P1 is carried by electrical cable 145 to junction box 140. The signal from pressure transducer P1, temperature transducer T1, specific gravity transducer SG1, air discharge flow meter 138 and the signal from pressure transducer P2 are transmitted from junction box 140 through cable bundle 146 to computer 150 which processes the data from the signals.

The present invention covers both conventional and under-balanced drilling. In conventional practices, fluid or drilling mud weight is maintained as close to the anticipated formation bottom-hole pressure as possible. In all under-balanced conditions, once the target zone is reached, gas and oil are encountered in severe volumes.

EXAMPLE I

A typical example of a drilling operation is presented using the invention with the following data:

FORMATION DEPTH=16000 FEET

4½ inch DRILL PIPE

DRILLING 6¾ HOLE

PUMP RATE=6 BBLS/MIN

DISPLACEMENT VOLUME=350 BBLS

CIRCULATING BOTTOMS-UP=58+MINUTES

ANTICIPATED FORMATION PRESSURE.=13,000 P.S.I.

WEIGHT OF MUD=15.0 LLBS/GAL.

HYDROSTATIC WEIGHT OF MUD AT 16000'=12,480 P.S.I.

Drilling is proceeding at a depth of 15998 feet with a penetration rate of 10 feet per hour. Utilizing a rotating head that seals on the drill pipe, fluid is forced to the surface and through the hydraulic choke 18, which at this time is fully open, then into the mud gas separator 21 to remove gas 24 and send the mud 28 back to the pits 12. The drilling is continued and upon reaching a depth of 16,000 feet, the pit monitor at the rig location shows a 5 barrels per minute gain in the return flow of mud. This means that drilling proceeded into a horizontal fracture and mud 28 has picked up about 75 barrels of oil and gas, which caused an increased in the return flow of mud 28 to 11 barrels per minute. The drilling personnel immediately engage the hydraulic choke 18 to correct the flow back to the mud separator 21 and into the pits 12 to 6 barrels per minute. After correcting the return flow, the annulus pressure is monitored at 400 p.s.i. At this time the decision by the well owner is made to increase mud weight to 15.4 pounds per gallon to increase bottom hole hydrostatic head to 12,800 p.s.i. After 24 minutes of drilling, the annular pressure has increased to 1500 p.s.i. due to gas expansion. Bottom-up volume begins to reach the surface at 50 minutes after taking the pit gain due to expansion of the gas in the annular space. When the mud 28 and gas combination reaches the choke manifold 18, surging takes place due to the layering of mud 28 and gas 24. At this time it is not uncommon for fluid rates to mud separator 21 to exceed 40 barrels per minute, with dry gas pockets being interspersed with mud 28. Under those circumstances mud separator 21 hydrostatic mud leg transducer 31 may register 11.7 psi, with gas section transducer 25 reading between 2 to 7 p.s.i., in a fluctuating pattern. As the bottoms-up with the mudloil mix reach the mud separator 21, the mud leg transducer 31 reading decreases to about 6.24 psi hydrostatic pressure because 8 lbs. per gallon oil instead of 15 lbs. per gallon mud is now in mud separator 21. This transition occurred over a period of 5 to 10 minutes and the differential pressure between the gas 24 and mud 28 indicates that the mud leg hydrostatic pressure is decreasing and gas pressure is increasing such that the mud separator 21 may blow dry. When the gas pressure transducer 25 pressure reading in the mud separator 21 increase to 90% of mud leg hydrostatic pressure while the mud leg (now oil) hydrostatic pressure is at 6.24 psi, thus the gas pressure is 5.62 psi, then the yellow warning light comes on to alert the drilling crew. If the gas pressure exceed 6.24 psi, the mud leg (now oil) hydrostatic pressure, then the red light comes on and an audible alarm activates to warn the operator to engage the hydraulic choke 18 and slow down the mud 28 pump 14 rate until the gas pressure returns to less than 90% of the mud leg hydrostatic pressure. The red light warms that the mud (now mostly oil) will blow over into the mud pit 12 causing hazardous hydrocarbons into the mud pit 12. The pit operator has about 5 minutes to divert the blow over mud and oil into a disposal pit. This situation would normally clear up within 15–20 minutes.

EXAMPLE II

The same above scenario as it applies to horizontal under balanced drilling. For example, the target zone has been reached, and the horizontal curve has been built. Upon extending the horizontal bore, the following pressures are observed. Annular pressure is 2500 p.s.i., drill pipe pressure is 2500 p.s.i., fluid pump rate is 8 b.p.m., mud weight is 14 lbs. per gallon. While drilling ahead, a 5 barrel pit gain is taken when a vertical fracture is hit. whereupon the hydraulic choke is adjusted back to 8 bpm of mud in and 8 bpm of mud out. Circulating the kick up, the annulus pressure increases to 5000 psi.

EXAMPLE III

This horizontal drilling scenario covers procedures utilized whenever conditions are not suitable for conventional or under-balanced drilling using mud. In depleted zones or formations that will not support a column of hydrostatic pressure, the following scenario criteria are as follows:

FORMATION DEPTH=16000 FEET

4½ inch DRILL PIPE

INJECTION RATE=1000 SCF/NITROGEN, 600 SCF/AIR AND ½ TO

2 BBL/MIN. OF TREATED WATER

DISPLACEMENT VOLUME=1965 SCF

ANTICIPATED FORMATION PRESSURE=1000 PSI

ANTICIPATED LATERAL LENGTH=2000 FEET

Initially, the well is drilled to the vertical depth where the depleted zone is located and then a cement plug is set. The curve angle is drilled and the operation is ready for horizontal drilling into the depleted zone. Up to this point the drilling operation is conventional technique with circulating fluid such as water or brine as drilling fluid.

The drilling fluid circulating pressure at this stage is 1200 to 1800 psi, and is displaced out of the bore hole with a gaseous mixture of 1,000 cfm nitrogen and 600 cfm air from compressor 6 to which is added ½ to 2 bbls. per minute of water chemically treated and having foaming properties for cooling the hydraulic actuated drill bit. The drill string is rotated 10 rpm while the hydraulic actuated drill bit turns and 25 to 45 rpm. The mud separator 21 is partially filled with water chemically treated and if necessary a pump 52 may be used to pump water from the water (mud) pit 12 to the separator 21. In horizontal phase of the drilling operation the gaseous mixture 24 is returned to the surface, it is controlled with the hydraulic choke 18 and enters the mud-gas separator 21 where solid cuttings and gaseous mixture are separated with water 28 being returned to the pits 12 and the gaseous mixture 24 vented to the atmosphere, it is necessary to calculate the volume of gas being circulated. The modified Weymouth formula adopted to calculate cubic feet per minute flow rates is used as follows:

$$\text{Equation I:}\quad Q = \frac{433.45\,Ta}{Pa} \times d^{2.667} \times \left(\frac{P_i^2 - P_f^2}{LSTZ}\right)^{1/2} \times \frac{1}{24 \times 60}$$

where:

-continued $Q$ = calculated volume of gases, *cfm*
$T_a$ = standard temperature ° $R$
$P_a$ = standard pressure absolute, psi
$d$ = internal pipe diameter, inches
$P_1$ = initial pressure, psi absolute
$P_2$ = terminal pressure, psi absolute
$P_f$ = $P_1 - P_2$
$L$ = length of pipeline in miles
$S$ = specific gravity of gas
$T$ = absolute temperature ° $R$ of flowing gases
$Z$ = compressibility of gas factor where:

Q=calculated volume of gases, cfm $T_a$=standard temperature °R $P_a$=standard pressure absolute, psi d=internal pipe diameter, inches $P_1$=initial pressure, psi absolute $P_2$=terminal pressure, psi absolute $P_f$=$P_1$–$P_2$ L=length of pipeline in miles S=specific gravity of gas T=absolute temperature °R of flowing gases Z=compressibility of gas factor In determining the value of S in Equations I and elsewhere, in the equations, "SpG" means specific gravity for purpose of the equation using that terminology.

The initial calculated volume of injected gas, $Q_1$, is calculated using Equation I with the following parameters:

$$S = \frac{SpG \text{ of Air} + SpG \text{ of } N_2}{2}$$

and current temperature transducer and current pressure transducer readings.

Next, when a consistent volume of injected gases is being circulated, the initially calculated volume of injected gas, $Q_1$, is corrected using Equation II:

$$\text{Equation II:} \quad Q_2 = Q_1 \times \left(\frac{Q_1}{V_A}\right)$$

$Q_2$=corrected initial volume of injected gases, cfm $V_A$=actual measured volume of injected gases, cfm When the corrected volume, $Q_2$, of injected gases being circulated indicates the presence of hydrocarbon gases (bottoms-up reaches the surface), the total quantity of gases, $Q_3$, is calculated using Equation I with the following parameters:

$$S = \frac{1/2(SpG \text{ of } N_2 + SpG \text{ of Air}) + SpG \text{ of Hydrocarbon gases}}{2}$$

and current temperature transducer and current pressure transducer pressure readings.

Then, the volume of hydrocarbon gases is calculated using Equation III:

$$Q_{HC}=Q_3-Q_2 \qquad \text{Equation III:}$$

where $Q_2$=corrected initial volume of injected gases, cfm $Q_3$=total volume, including hydrocarbon gases, cfm $Q_{HC}$=volume of hydrocarbon gases,cfm Then, the actual $SpG_F$ of hydrocarbon gases and injected gases is calculated using Equation IV as follows:

$$SpG_F=(a)+(b) \qquad \text{Equation IV:}$$

where:

$$(a) = \frac{Q_{HC}}{Q_3} \times SpG \text{ of Hydrocarbon gases}$$

$$(b) = \frac{Q_2}{Q_3} \times SpG \text{ of injected gases (air and } N_2 \text{ mix)}$$

$SpG_F$=actual SpG allocated to injected gases and formation gases

Then, $Q_{FT}$ is calculated using Equation I and S equals $SpG_F$ of injected and formation gases and the parameters for the current temperature transducer and current pressure transducer pressure readings.

Then $Q_{FH}$ is calculated using Equation V:

$$Q_{FH}=Q_{FT}-Q_2 \qquad \text{Equation V:}$$

where:

$Q_{FT}$=final total gas, cfm $Q_{FH}$=final hydrocarbon gases, cfm

If final, $Q_{FT}$ is 2000 to 2100 cfm, then the air and $N_2$ can be reduced by about ½ of the difference (2000–1600=400) or 200–250 cfm which save on $N_2$ and maintains the 1200 to 1800 psi circulating pressure.

The total volume $Q_{FT}$ is periodically calculated so that the air and nitrogen injection volumes may be adjusted to maintain the engineering design pressures and volumes for efficient drilling of the depleted zone to the target location, whether lateral, directional or vertical.

EXAMPLE IV

Formation Depth=16000 feet

4½ inch drill pipe

4¾ hole

Pump Rate=2500 SCFPM

Circulating Bottoms-Up=50+Minutes

Anticipated Formation Pressure=1000 P.S.I.

Additional Depth=500 feet

Drilling is proceeding at depth of 16000 feet with a penetration rate of ½ feet per minute. Utilizing a high pressure rotating B.O.P. sealing on the pipe, the air-nitrogen mixture injected into the drill string is diverted out the drilling spool and into an 8 inch I.D. flare line directly to the disposal facility or flare, where the mixture is ignited when sufficient gaseous hydrocarbons are present. The air-nitrogen mixture ratio is 1800 s.c.f.m. Air and 600 s.f.c.m. Nitrogen added for prevention of downhole flare. As drilling continues, increases in formation gas are noted and recorded. The change in calculation for this type of operation requires utilizing a differential calculation using $P_1$–$P_2$ as $P_f$ in the Equation I Typically, pressure in the drill string I in the 1000 to 1500 p.s.i. range, with annular pressure reaching 400 to 800 p.s.i. Flowing pressure in the vent line, which is an 8.5 O.D. pipe, ranges from 1.5 to 15 p.s.i. It should be noted that the desired flow line pressure is between 0.1 and 20 p.s.i. and the vent line diameter is determined to maintain this range of pressure. After each joint of pipe is drilled down, circulating five to ten minutes prevents accumulation of solids around the bit. Equations I through IV are applicable to this example IV with the exception that $P_2$ described in connection with the modified Weymouth formula of equation I is not equal to the observed pressure and is denominated $P_f$ in equation I which is equal to $P_1$, the pressure observed at the beginning of the laminar flow segment from the drill site less the observed pressure $P_2$ near the end of the laminar flow segment nearest the disposal facility.

The same procedure can be utilized without Nitrogen by injecting 15 to 17 gallons of water based foam per hour for cooling and solids carrying.

What is claimed is:

1. A computerized monitoring system for oil and gas drilling operations to provide indications of conditions in a well bore comprising:

i. an injection line including a pump for injecting gas into a drill string;

ii. a gas return line having a laminar flow segment for transporting return gas containing a mixture of gas and other hydrocarbons from the drill string to a flare;

iii. a first gas pressure transducer for measuring the gas pressure in the laminar flow segment nearest the drill string;

iv. a thermal transducer for measuring the temperature of the gas adjacent the first gas pressure transducer;

v. a second gas pressure transducer located in the laminar flow segment of the gas return line nearest the flare;

vi. a monitor display at the drilling rig to indicate conditions of the return gas; and vii. a computer for analyzing data from all the transducers and determining changes in the conditions of the return gas.

2. The computerized monitoring system of claim 1 wherein the volume of formation gases is determined by the computer using an equation A as follows:

$$\text{equation A:}\quad Q = 42_a\sqrt{\frac{P_1^2 - P_f^2}{L}}$$

where:

Q=discharge in cubic feet per hour

42=a constant $P_1$=initial pressure in lbs. Per square inch, absolute $P_2$=final pressure in pounds per square inches, absolute $P_f$=$P_1$−$P_2$ L=length of line in miles a=diameter coefficient Using specific gravity of gas as 0.6.

3. The computerized monitoring system of claim 2 where specific gravity of the gas is not 0.6, volume of gas, Q, is corrected by using equation B as follows:

$$\text{equation B:}\quad Q_C = Q\sqrt{\frac{.06}{sp\cdot \text{gr}\cdot \text{gas}}}$$

where:

Q=discharge in CFH $Q_C$=corrected volume.

4. A computerized monitoring system for oil and gas drilling operations employing a drilling rig to drill a well bore using injection gases as circulating drilling fluid through a drill string and returning it to a disposal facility to provide data for safe operations comprising:

i. the drill string of the drilling rig;

ii. an injection line for injecting gas into the drill string;

iii. gas pressurizing apparatus for pressurizing and injecting gas into the injection line;

iv. a gas transfer line having a laminar flow segment for transporting gas from the well bore containing a mixture of injection gas, natural gas and formation cuttings to the disposal facility;

v. a first gas pressure transducer nearest the well bore located in the laminar flow segment;

vi. a second gas pressure transducer located in the laminar flow segment and spaced apart from the first gas pressure transducer;

vii. a thermal transducer positioned near the first gas pressure transducer for measuring the temperature of the gas;

viii. a monitor display at the drilling rig to indicate conditions of the well bore; and ix. a computer for analyzing data from the transducers and determining:

(a) first volume of injected gas, $Q_1$, flowing to the disposal facility using the following general equation I: equation I:

$$Q = \frac{433.45\,Ta}{Pa}\times d^{2.667}\times\left(\frac{P_1^2 - P_f^2}{LSTZ}\right)^{1/2}\times\frac{1}{24\times 60}$$

where:

Q=calculated volume of gases, cfm $T_a$=standard temperature °R $P_a$=standard pressure absolute, psia d=internal pipe diameter, inches $P_1$=initial pressure, psi absolute $P_2$=terminal pressure, psi absolute $P_f$=$P_1$−$P_2$ L=length of pipeline in miles S=specific gravity of gas T=absolute temperature °R of flowing gases Z=compressibility of gas factor (b) and adjusting the first volume of injected gas flowing to the disposal facility using the ratio of the calculated volume of gases over gas volume using the following equation II:

$$Q_2 = Q_1\times\left(\frac{Q_1}{V_A}\right)$$

where $Q_1$=calculated volume of gases, cfm $Q_2$=corrected initial volume of injected gases, cfm $V_A$=actual measured volume of injected gases, cfm.

5. The computerized monitoring system of claim 4 wherein the total volume of injected and formation gases, $Q_3$, flowing to the disposal facility is determined using equation I with the following parameters:

$$S = \frac{1/2(SpG \text{ of } N_2 + SpG \text{ of Air}) + SpG \text{ of Hydrocarbon gases}}{2}$$

and current temperature transducer and current pressure transducer pressure readings.

6. The computerized monitoring system in claim 5 wherein a volume of hydrocarbon gases, $Q_{HC}$, is calculated using equation III:

$$Q_{HC}=Q_3-Q_2 \quad \text{equation III:}$$

where:

$Q_2$=corrected initial volume of injected gases, cfm $Q_3$=total volume, including hydrocarbon gases, cfm $Q_{HC}$=volume of hydrocarbon gases, cfm.

7. The computerized monitoring system in claim 6 wherein the actual specific gravity, $SpG_F$, of the injected gases and the specific gravity of the hydrocarbon gases are calculated using equation IV as follows:

$$SpG_F=(a)+(b) \quad \text{equation IV:}$$

where:

$$(a) = \frac{Q_{HC}}{Q_3} \times SpG \text{ of Hydrocarbon gases}$$

-continued $$(b) = \frac{Q_2}{Q_3} \times SpG \text{ of injected gases (air and } N_2 \text{ mix)}$$

$SpG_F$=actual specific gravity allocated to injected gases and formation gases.

8. The computerized monitoring system in claim 7 wherein a final total gas, $Q_{FT}$, is calculated using the general equation I with the following parameters: the specific gravity, S, is $SpG_F$ of the injected and formation gases determined by equation IV and the current temperature transducer and current pressure transducer pressure readings.

9. The computerized monitoring system in claim 8 wherein the final total volume of hydrocarbon gases is calculated using equation V:

$$Q_{FH}=Q_{FT}-Q_2 \quad \text{equation V:}$$

where $Q_2$=corrected initial volume of gases, cfm $Q_{FT}$=final total gas, cfm $Q_{FH}$=final hydrocarbon gases, cfm.

10. The computerized monitoring system of claim 9 wherein the gas injected into the injection line is reduced by the volume of the hydrocarbon gases.

* * * * *